United States Patent [19]

Mindermann et al.

[11] Patent Number: 4,895,082

[45] Date of Patent: Jan. 23, 1990

[54] TECHNIQUE FOR CONTROLLING THE COMBUSTION OF FUEL HAVING FLUCTUATING THERMAL VALUES

[76] Inventors: Kurt-Henry Mindermann, Eggerscheidter Str. 112, D-4030 Ratingen; Franz Wintrich, Berkenberg 25a, D-4300 Essen 13, both of Fed. Rep. of Germany

[21] Appl. No.: 261,514

[22] Filed: Oct. 24, 1988

[30] Foreign Application Priority Data

Oct. 24, 1987 [DE] Fed. Rep. of Germany ..... 3736067

[51] Int. Cl.[4] ..... F23N 5/18

[52] U.S. Cl. ..... 110/186; 110/101 CB; 110/101 CC; 110/205; 110/302; 110/346; 236/14; 236/15 E

[58] Field of Search ..... 110/185, 186, 188, 346, 110/347, 101 CB, 101 CC, 204, 205302; 236/15 E, 14, 15 BC

[56] References Cited

U.S. PATENT DOCUMENTS

| | | | |
|---|---|---|---|
| 1,602,092 | 10/1926 | Witz | 110/188 |
| 3,223,058 | 12/1985 | Tanner . | |
| 3,223,326 | 12/1965 | Livingston . | |
| 3,671,167 | 1/1971 | Nakano . | |
| 4,250,820 | 2/1981 | Lautenschlager | 110/302 X |
| 4,315,468 | 2/1982 | Tyer et al. . | |
| 4,331,085 | 5/1982 | Tyer et al. . | |
| 4,331,086 | 5/1982 | Fitch et al. . | |
| 4,385,567 | 5/1983 | Voss | 110/186 |
| 4,430,963 | 2/1984 | Finet | 110/101 CC |
| 4,441,435 | 4/1984 | Miyamoto . | |
| 4,510,873 | 4/1985 | Shigaki | 110/302 X |
| 4,555,800 | 11/1985 | Nishikawa et al. . | |

FOREIGN PATENT DOCUMENTS

| | | | |
|---|---|---|---|
| 0039909 | 11/1981 | European Pat. Off. . | |
| 0160884 | 11/1985 | European Pat. Off. . | |
| 3514609 | 11/1985 | Fed. Rep. of Germany . | |
| 786908 | 9/1935 | France . | |
| 095464 | 2/1972 | France . | |
| 0025609 | 3/1981 | Japan | 110/188 |
| 0040018 | 4/1981 | Japan | 110/186 |

OTHER PUBLICATIONS

Patent Abstracts of Japan, Band 10, Nr. 238 (M-508), [2294], 8/16/86; & JP-A-61-70315 (Ebara Corp.), 4/11/86.

Patent Abstracts of Japan, Band 6, Nr. 167 (M-153), [1045], 8/31/82; & JP-A-5782609 (Kubota Tekko K.K.), 5/24/82.

Patent Abstracts of Japan, Band 6, Nr. 101 (M-135), [979], 6/10/82; & JP-A-5733713 (Nippon Kokan K.K.), 2/23/82.

Patent Abstracts of Japan, Band 5, Nr. 131 (M-84), [803], 8/21/81; & JP-A-5668714 (Tokyo Shibaura Denki K.K.), 6/9/81.

Patent Abstracts of Japan, Band 8, Nr. 224 (M-331), [1661], 10/13/84: & JP-A-59107111 (Ebara Seisakusho K.K.), 6/21/84.

Automatisme, Band 13, Nr. 5, May 5, 1968, J. Jullien: "Controle Centralise et Regulation des Usines de Traitment Industriel des Residus Orbains".

*Primary Examiner*—Edward G. Favors

*Attorney, Agent, or Firm*—Frishauf, Holtz, Goodman & Woodward

[57] ABSTRACT

The combustion of fuel having a highly fluctuating thermal value is controlled to permit optimization of air supply and reduction of waste gas impurities. The fuel passes through a combustion chamber having a degassing and evaporation zone, a primary combustion zone, and a secondary combustion zone. Measurements are taken in the evaporation and degassification zone to determine the thermal value of the fuel. This is done by detecting the intensity of $H_2O$ and/or $CO_2$ spectra emanating from the fuel. The measurement results are utilized to optimize the combustion parameters. Such measurements are also made in the following zones in order to provide further control of the combustion process.

15 Claims, 6 Drawing Sheets

18
10
6
24
12
26
50
28
51
11
52
30
5
22
53
54
55
14
50a
51a
52a
53a
16
55a
54a

TECHNIQUE FOR CONTROLLING THE COMBUSTION OF FUEL HAVING FLUCTUATING THERMAL VALUES

BACKGROUND OF THE INVENTION

The present invention is directed to a combustion control technique and, in particular, for controlling the combustion of fuel, such as refuse in the nature of waste or household garbage, for example, having widely fluctuating thermal values.

A typical combustion plant burns a fuel, and the resulting combustion gases are directed to flow over a heat exchanger forming part of a steam generator. Combustion occurs in a combustion chamber having an opening at one end through which fuel is input and an opening at another end through which ash is removed. The combustion chamber includes a degassing and evaporating zone, a primary combustion zone, and a secondary combustion zone. The degassing and evaporation zone is adjacent the input opening and is, thus, the first zone through which the fuel passes. In this zone, the fuel is subject to heat emanating from the primary combustion zone which is right next to it. The fuel is heated and dried in this first zone, and hydrocarbons are evaporated. Also, some of the fuel may begin to burn. In the primary combustion zone, most of the heat is generated as combustion occurs throughout the fuel located in this zone. All the fuel has ignited, to the extent possible depending on the fuel type, before it leaves this zone. In the secondary zone, the burning fuel remains, or dwells, until it is reduced to ash. The heat is passed through a heat exchanger to a steam generator.

Other than in fossil fueled power plants, the control of combustion in a conventional plant such as is described above, but for burning refuse, is typically done manually by an operator. The operator observes the combustion taking place in the combustion chamber, and changes one or more of the parameters which affect combustion accordingly. Thus, for example, if the combustion has flared to an unacceptable extent, it is damped by reducing the fuel feed rate (i.e. fuel mass flow). If, on the other hand, the combustion has died down below the desired level, the fuel feed rate is increased. Other parameters which affect combustion can also be changed, such as, the volume of primary combustion air supplied from beneath the fuel to each of the three different zones mentioned above, and the relative rate with which fuel is passed through each of the three above-mentioned zones.

It is possible to express the quantity of heat in the combustion chamber with the following equation:

$$Q = M_m \times H_u \tag{1}$$

where

Q is heat flow in Kilopond x calories $M_m$ is mass of fuel in Kiloponds and $H_u$ is thermal value of the fuel in calories.

Variation of the heat flow is expressed as $$\frac{dQ}{dt} = \frac{d(M_m \times H_u)}{dt} \tag{2}$$

$$\text{Thus, } \frac{dQ}{dt} = \frac{dM_m}{dt} \times H_u + \frac{dH_u}{dt} \times M_m \tag{3}$$

Automatic control of the combustion process has been attempted. This has been done in combustion plants fueled with conventional fossil fuels such as coal, heavy oil, or natural gas which have a relatively uniform thermal value. The steam mass flow from the steam generator is monitored and serves as the controlling parameter for the $dH_u/dt$ term of equation (3) for varying, for example, the fuel and/or air supply rate to effect the requisite change in the combustion process. A certain time delay inevitably occurs between passage in the combustion chamber of the fuel which generates a measured steam mass flow value, and application of the combustion control signal responsive thereto. Nevertheless, such a delay is acceptable because, as mentioned above, the fluctuation in thermal value of such fuels is relatively low. However, for fuels having a highly fluctuating thermal value, such a delay as occurs from using the steam mass flow as the $dH_u/dt$ control parameter is not acceptable. For example, if the fuel is refuse such as household waste and garbage, a bundle of newspaper may be followed by a large mass of garden debris, followed by plastic containers, glass, and so on. These materials have very different relative thermal values. Thus, fuel composed of such materials has a widely fluctuating thermal value. Therefore if the steam mass flow from the steam generator is monitored while the bundle of newspaper is being consumed, for example, it will likely indicate increased combustion due to the high thermal value of paper. Consequently, the control system will tend to reduce the combustion. However, by the time the control system reacts, the newspaper may have been consumed, passed out of the combustion chamber, and the fuel may be grass for which combustion parameters are required to raise the combustion level. As a result, this prior art technique may produce pollutants, incomplete combustion causing the danger of hot, glowing coals being passed to the ash bin, and other disadvantages. Consequently, it is necessary with a fuel having a widely fluctuating thermal value to take the correct value for the $dH_u/dt$ term into account by providing combustion feedback with a faster response time.

It has already been tried to determine the variation of fuel mass density by detecting the air permeability of the fuel as it is passing through the degassing and evaporation zone of the combustion chamber. This has been done by measuring the pressure drop in the primary combustion air across the layer of fuel and varying the fuel feed rate such that the average density of the fuel is kept relatively constant. However, the steam mass flow serves in such a technique as the controlling value for $dH_u/dt$. This approach still has the dual drawbacks of a very long delay or dead time, and the lack of a good, accurate $dH_u/dt$ term.

Because previous efforts to control combustion of fuel with a highly fluctuating thermal value involve a relatively long dead time, complete combustion may not be attained. This increases pollution levels, such as carbon monoxide, emanating from the combustion chamber. In order to keep the ratio of $$\lambda = \frac{\text{air}}{\text{combustion gas}}$$

below acceptable levels, great quantities of air must be introduced into the plant. This requires large and expensive machinery.

SUMMARY OF THE INVENTION

It is a primary object of the present invention to reduce delay, or dead time, involved in using a measurement of thermal value for controlling the combustion of fuel, such as household waste, having a highly fluctuating thermal value.

Another object of the present invention is to obtain a thermal value measurement of the fuel before significant combustion thereof occurs.

One other object of the present invention is to provide a waste control technique which results in complete consumption of the fuel in the combustion chamber.

A further object of the present invention is to provide a combustion control technique for reducing waste gas pollution.

Yet another object of the present invention is to provide a combustion control technique which can utilize less air to maintain an acceptable ratio λ, and permits, therefore, the use of smaller, less expensive air flow machinery.

These and other objects of the present invention are attained in accordance with one aspect of the present invention by a method for controlling combustion of fuel having widely fluctuating thermal values, comprising the steps of: feeding the fuel to a grid in a combustion chamber via an inlet thereof, conveying the fuel along the grid through a degassing and evaporating zone, a primary combustion zone, and a secondary combustion zone in the combustion chamber to an ash removal station; supplying primary combustion air to the grid from therebeneath; obtaining, in an area including the inlet and the degassing and evaporating zone, a measurement signal related to at least one of the (i) water content of the fuel, and (ii) carbon dioxide content of the combustion gases; and controlling at least one parameter affecting combustion of the fuel in the combustion chamber in response to the measurement signal.

Another aspect of the present invention is directed to a method for controlling combustion of fuel having widely fluctuating thermal values, comprising the steps of: feeding the fuel to a grid in a combustion chamber thereof via an inlet; conveying the fuel along the grid through a degassing and evaporating zone, a primary combustion zone, and a secondary combustion zone in the combustion chamber to an ash removal station; supplying primary combustion air to the grid from therebeneath; determining the thermal value from properties of combustion gases detected in an area including the inlet and the degassing and evaporating zone; detecting fuel density on the grid in the area; and controlling the feeding of fuel to the grid in response to the thermal value and the fuel density so as to derive a constant thermal output.

DETAILED DESCRIPTION OF THE PREFERRED EMBODIMENT

In order to attain the primary object of the present invention of obtaining a faster response time for controlling the combustion process relative to the fuel actually being burned, it is imperative to measure the thermal value of the fuel in such a way that this information can be timely conveyed to a combustion control system. Accordingly, an important aspect of the present invention is the discovery that, in most cases, the water content of fuel is indicative of its thermal value. Some materials and substances, such as glass and metals, have a relatively low water content so as to make its measurement in this context of little value. As to these, a measurement of the emitted carbon dioxide is used as being indicative of thermal value. Thus, the present invention contemplates using a combination of $H_2O$ and $CO_2$ signals in order to thus provide an indication of thermal value for a wide range of materials to include even those in which one or the other used alone is of minimal significance as to thermal value. In accordance with the preferred embodiment, these two signals are added to derive a thermal value signal.

It is essential to measure the thermal value in the manner described above as early as possible in the combustion process. The thermal value thus obtained is utilized in the combustion plant and its control system, as described in detail below.

Figure 1:
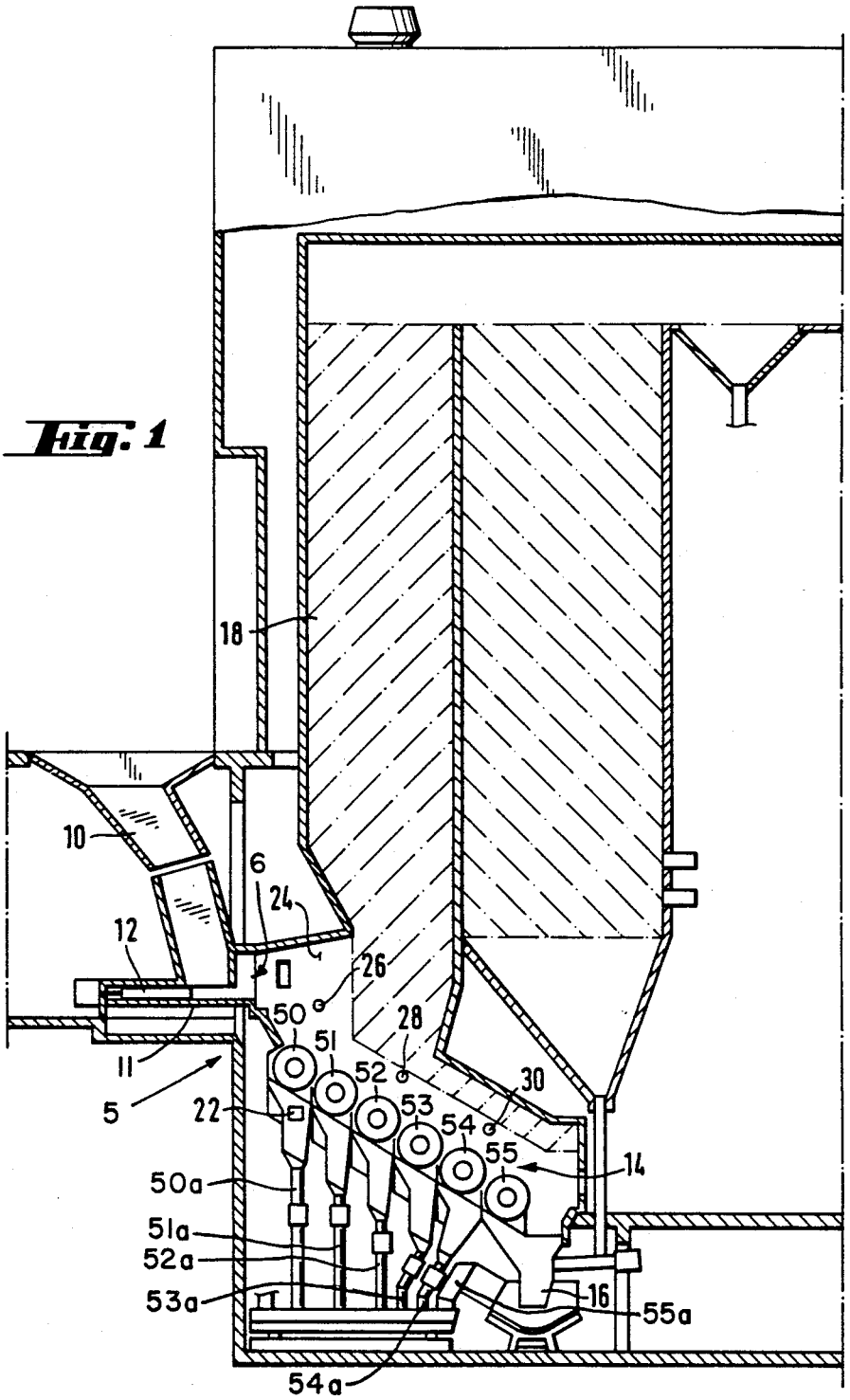
FIG. 1 shows an elevational cross section of a combustion plant.
Figure 2:
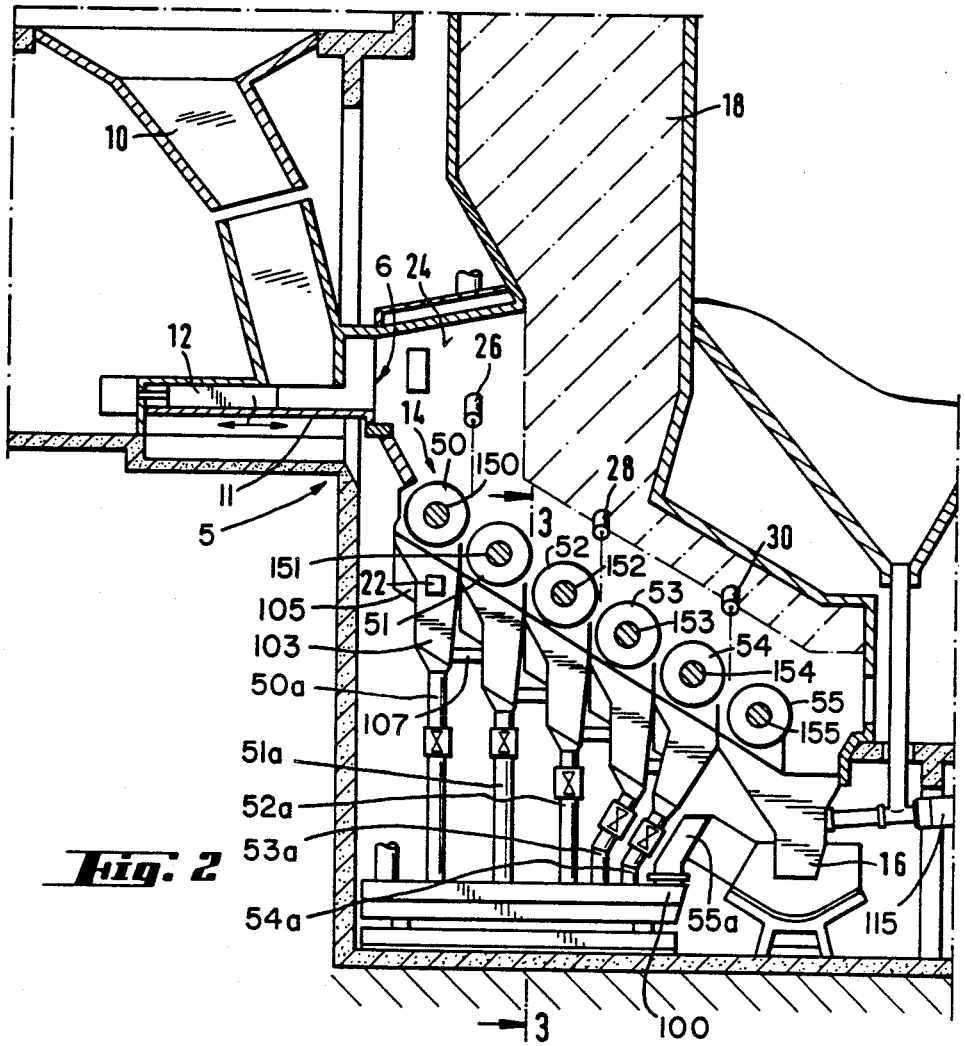
FIG. 2 is an expanded partial cross section corresponding to FIG. 1, and showing the combustion chamber.

Turning first to the combustion plant, FIGS. 1 and 2 show steam generator 18 having combustion chamber 5 arranged below it. Steam generator 18 is illustrated only schematically since its structure can be conventional and because it does not form a direct part of the present invention. Combustion chamber 5 has an opening 6 to which fuel is supplied via chute 10. A pusher rod 12 reciprocates toward and away from opening 6, and is so arranged that fuel deposited from chute 10 onto surface 11 can be forced through opening 6 by motion of reciprocating pusher rod 12.

Combustion chamber 5 includes a conveyor arrangement, or grid, 14 for transporting the fuel from opening 6 to ash disposal station 16 at the other end thereof. The grid 14 includes identical cylindrical drums 50, 51, 52, 53, 54 and 55 arranged adjacent to each other and with parallel axes. Each of these drums has a corresponding shaft 150–155, respectively, the ends of which are journalled into a suitable retainer 110 (see FIG. 3). Clockwise rotation of these drums results in conveying fuel landed on drum 50 sequentially to drum 51, 52, and so on until the consumed fuel falls off drum 55 and into ash disposal station 16.

Figure 3:
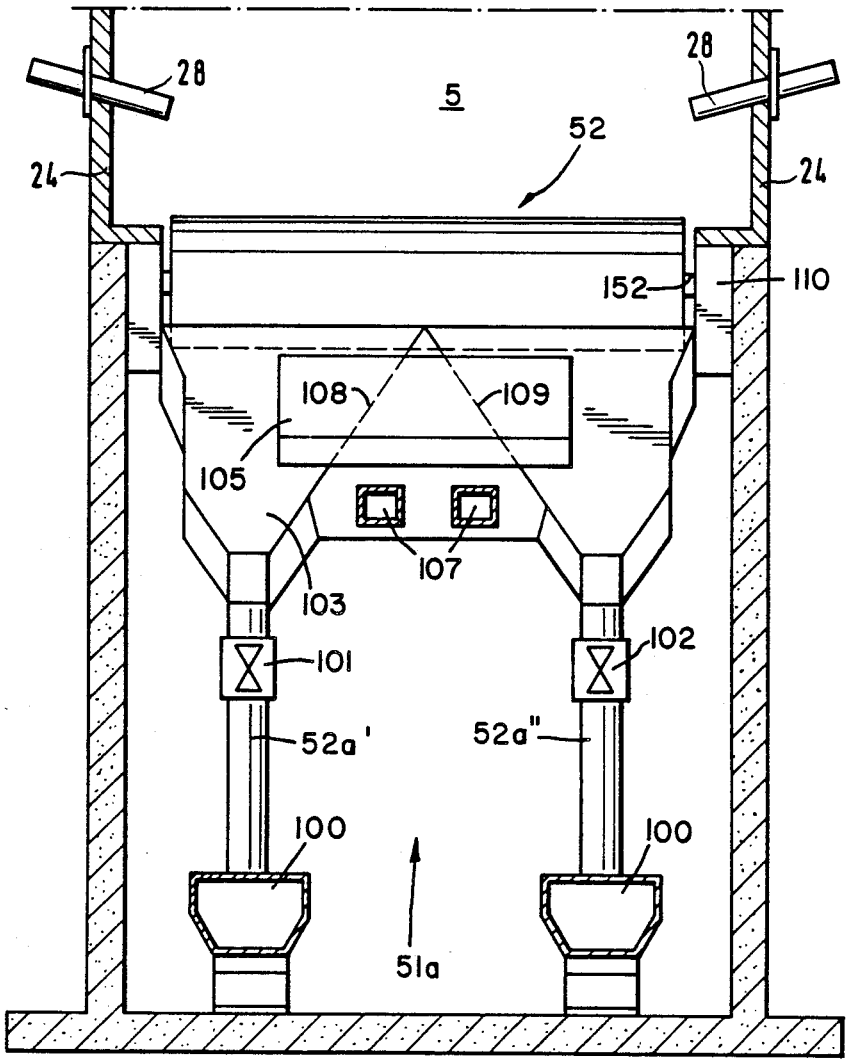
FIG. 3 is a cross section taken along line 3—3 in FIG. 2.

Each of drums 50–54 is provided from below with a respective air supply duct 50*a*–54*a*. Each of ducts 50*a*–54*a* is split into two legs, as shown in FIG. 3. Thus, FIG. 3*a* shows duct 52*a* as having a left leg portion 52*a*', and a right leg portion 52*a* ''. Each of the ducts also includes a plenum 103 (shown partially in perspective in FIG. 3), and a skirt 105. Plenum 103 is divided by partitioning walls 108 and 109 into sections through which air flow from legs 52'*a*and 52*a*'', respectively, is directed into the combustion chamber. Reinforcing bars 107 connect adjacent ducts to each other for added strength and rigidity of the overall structure. Valves 101 and 102 control air flow to each side of the plenum and, also, of the combustion chamber 5. This, as will be discussed below, provides an added measure of combustion control by regulating air flow in the combustion chamber. Main ducts 100 feed combustion air from primary air fan 115 to the respective duct legs leading to drums 50–54 in grid 14.

Pressure sensor 22 is disposed in plenum 103 leading to drum 50. The output of sensor 22 will vary in response to the extent of throttling applied by the fuel layer on the grid to air supplied through the ducts 50*a* and 51*a*. Thus, the output signal of pressure sensor 22 is indicative of average fuel mass density at a given time in the degassing and evaporation zone.

Combustion chamber 5 is divided into a degassing and evaporation zone defined by drum 50, a primary combustion zone defined by drums 51 and 52, a secondary combustion zone defined by drums 53 and 54, an ash disposal station at drum 55. Primary combustion air consisting of ambient air blown in by primary air fan 115, and perhaps heated by an economizer, is directed to each of the three zones. The relative amount of air directed to each zone is controlled in the manner explained below.

The degassing and evaporation zone is heated by the combustion occurring in the primary combustion zone which is adjacent to it. Temperatures of 300°–500° C. are thus produced in the degassing and evaporation zone to cause fuel passing through it to emit, inter alia, water and carbon dioxide.

Sensors are provided to detect such emissions. In particular, as best shown in FIGS. 2 and 3, detector tubes 26 are mounted into walls 24 of combustion chamber 5. While the degassing and evaporation zone is provided with tubes 26, the primary combustion zone is provided with tubes 28, and the secondary combustion zone is provided with tubes 30. These tubes carry in their outer ends electro-optical sensors and, as appropriate, filters. The signal generated by such sensors is input to suitable processing electronics. These components are designed to detect a spectrum of interest and, in particular, that of water and/or carbon dioxide. The various components are selected accordingly. The spectra of interest are those of $H_2O$ and $CO_2$, as explained above. Such devices are old and well known in the art. Therefore, supplying further details thereof is not deemed necessary other than to say they are obtainable from BFI Automation in Ratingen, Fed. Rep. Germany.

As best shown in FIG. 3 for tubes 28, but applicable to tubes 26 and 30 as well, a pair of tubes is used, with one being mounted on the right side and one on the left side of the chamber as depicted in this drawing. The tubes 28 are positioned in the primary combustion zone, preferably in the flame front, so as to monitor the very combustion. Tubes 28 monitor at least the same parameters as tubes 26. Tubes 30 are primarily utilized to measure temperature in the secondary combustion zone. The particular number of tubes is related to the size of the combustion chamber and each zone therein.

One of several ways of controlling combustion can be selected for responding to the information collected by detectors 26, 28 and 30. For example:

distribution of primary combustion air among the zones, distribution of fuel mass in the zones, distribution of secondary combustion air over the zones, such secondary combustion air being supplied from above the fuel, combustion air volume supplied per unit time, or temperature of supplied combustion air.

Figure 4:
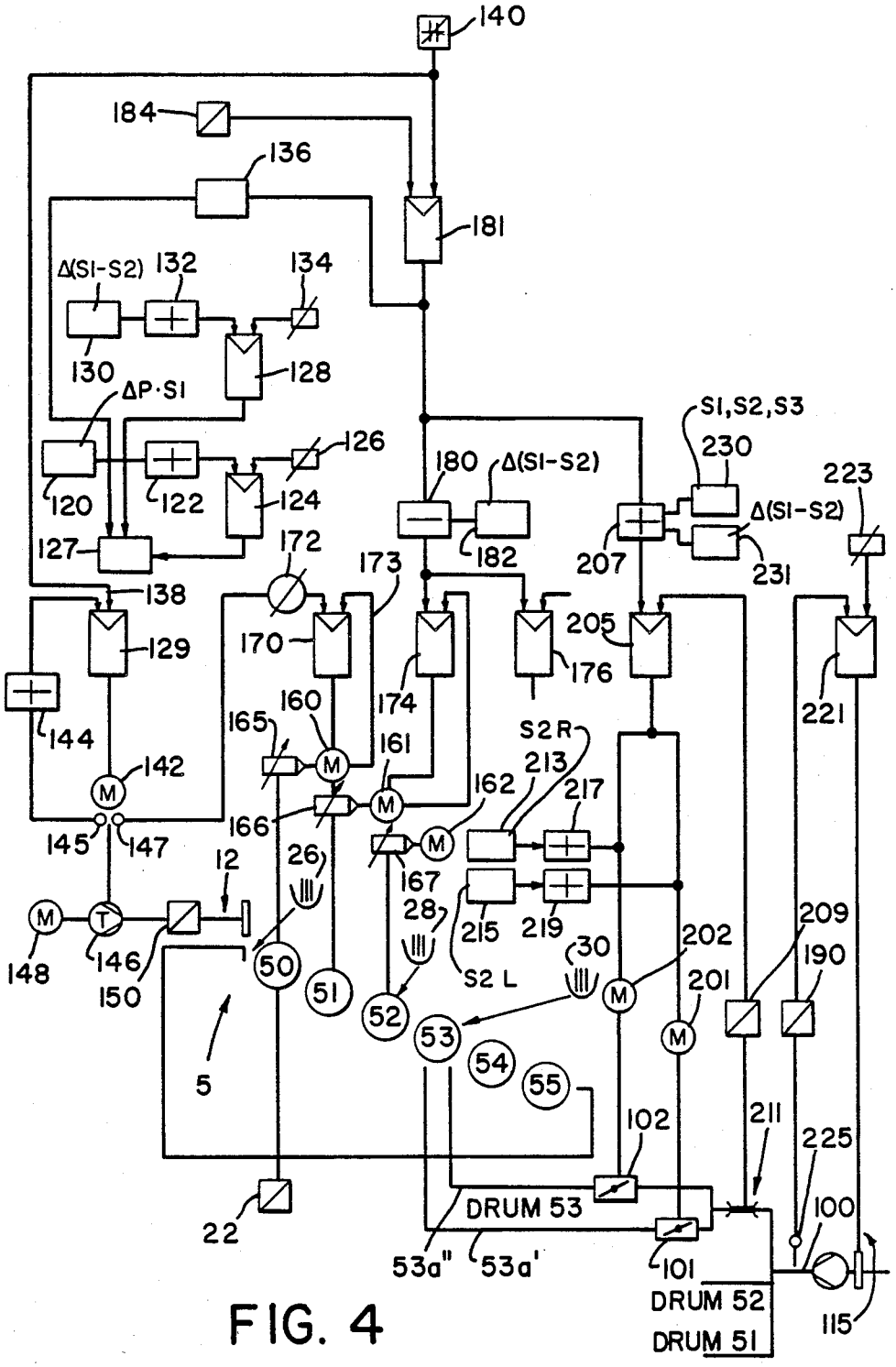
FIG. 4 is a schematic circuit, partially in block diagram form, of a control circuit of the invention.

FIG. 4 discloses a circuit diagram for controlling a waste combustion plant in accordance with the present invention. In particular, chamber 5 is shown as including drums 50–55 along with sensors 26, 28 and 30. Reciprocating fuel pusher rod 12 is shown at the entrance 6 to chamber 5. Primary air fan 115 forces air through main duct 100 to ducts branching off to drums 50–54. For ease and simplicity of illustration, only the ducts leading to drum 53 are shown in detail. The same arrangement is made for drums 51–54. However, a slight variation is made for drum 50 in that valves 101 and 102 are not used for it. In order for sensor 22 to provide a meaningful pressure signal indicative of mass density, air flow to drum 50 must be maintained constant. Thus, no need exists for valves 101 and 102.

As indicated above, the signal obtained from sensors 26 is the sum of the detected values for $H_2O$ and $CO_2$. A mean value of this sum forms thermal value signal S1. Similar measurements are taken in the primary combustion chamber, and the mean value thereof forms signal S2. A pressure differential signal $\Delta P$ is generated by sensor 22, in the manner discussed above. The $\Delta P$ signal corresponds to the $dM_m/dt$ term while the S1 signal corresponds to the $dH_u/dt$ term in equation (3) above. Thus, $\Delta P \times S1$ is indicative of the variation of heat with respect to time, dQ/dt. This forms a valuable control parameter for governing the combustion process in chamber 5. In particular, circuit 120 received the $\Delta P$ and S1 signals, and provides the dQ/dt signal to conditioning circuit 122 which adapts, or conditions, the output of circuit 122 so as to be compatible with regulator 124. Regulator 124 compares the conditioned dQ/dt signal with a preset signal from heat level setting device 126. The output of regulator 124 is provided to regulator 129 via summing circuit 127 which receives several other signals, as discussed below.

One of the other signals fed to regulator 12 is from regulator 128. As explained above, signal S2 is generated in the primary combustion chamber by sensors 28, and S2 correspond to signal S1 in terms of representing the variation of heat with respect to time in the primary combustion chamber. The difference between S1 and S2 is obtained in circuit 130, the output of which is provided to conditioning circuit 132. The output of conditioning circuit 132 is compared with a preset value from a reference level setting device 134 to generate the output signal of regulator 128. Along with the signals from regulators 124 and 128, a third signal from fuel quality circuit 136 is received by summing circuit 127. This latter signal is generated as follows.

Main control 140 is adjusted by the operator to set the generated steam flow from generator 18 at a desired flow of so many tons/hr. Processing circuit 184 receives a signal from a suitable detector of steam flow (not shown), and generates a feedback signal which is compared by regulator 181 to the value set by main control 140. The difference between the set value of steam flow and the measured value is provided at the output of regulator 181 to integrator 136. A fuel quality signal is generated at the output of integrator 136 in the sense that a measured steam flow below that which is set by 140 indicates fuel with relatively poorer heat generating quality (i.e. thermal value), and vice versa. The output of integrator 136 is fed to summing circuit 127.

The three above-mentioned signals from integrator 136, regulator 128 and regulator 124 are combined into a single input line 138 at the output of summing circuit 127. Line 138 conveys a summed signal to regulator 129 which also receives the preset value from main control 140. These two signals, one from device 140 and one on line 138, control the operation of motor 142 in the manner described below.

Motor 142 is a positioning motor for adjusting the position of hydraulic throttle value 146. Motor 148 is a pump for generating pressurized fluid to be passed via valve 146 to hydraulic cylinder 150 to actuate the operation of reciprocating pusher rod 12. The speed and direction of motion of pusher rod 12 is set by valve 146 under the control of motor 142.

Transducer 145 senses the position of motor 142 and provides a negative feedback signal through conditioning circuit 144 to the input of regulator 129. Any deviation of motor 142 from the position set by the other two input signals to regulator 129 is, thus, suitably corrected. Sensor 147 detects whether the position of motor 142 is such a to extend the pusher rod 12 into the opening, or to retract it away. This signal is utilized in the manner described below for controlling operation of drum 50.

The signal produced by regulator 128 is indicative of where the "center of gravity" of the fire is located with respect to the first two zones. A detailed discussion of "center of gravity" is provided below with respect to FIGS. 6(*a*)–6(*c*). If the "center of gravity" is sensed as being relatively close to opening 6 into combustion chamber 5, regulator 128 generates a signal to speed up the advance of pusher rod 12 toward opening 6. This is a safety precaution to stack up additional fuel at the opening 6 to prevent the possibility of fire reaching the opening itself because this could damage the machinery at the opening which are not designed to withstand actual flames. Thus, if regulator 128 senses a value of $\Delta S$ exceeding the reference value set by device 134, a signal is generated to provide an increase in the operating speed of pusher rod 12. The value to which 134 is set and the signal level generated by regulator 128 are dependent on parameters peculiar to the dimensions, capacity, type, etc. of a particular waste combustion plant. Consequently, it is not deemed necessary to provide these details which are readily apparent to one with ordinary skill in the art.

The signal generated by regulator 124 affects the operation of pusher rod 12 commensurate with the detected value of dQ/dt in comparison with the preset value. Signal level setting device 126 provides a reference signal commensurate with the desired steam flow value set by main control 140. While main control 140 sets a reference value for steam flow, signal level setting device 126 sets a commensurate reference value for dQ/dt. When the difference between the outputs of circuits 122 and 126 indicates that a fuel is positioned at the degassification and evaporation zone with a relatively low thermal value (i.e. as determined by signal S1), the control signal from regulator 124 tends to speed up pusher rod 12 in order to provide more fuel to the primary combustion chamber so that the desired level of heat, and therefore steam flow, can be achieved. If, on the other hand, signal $\Delta P \times S1$ from circuit 120 via circuit 122, when compared to the reference level from circuit 126, indicates a highly combustible fuel in the first zone (i.e. having a high thermal value as determined by signal S1) and/or a high mass density (as indicated by $\Delta P$), the output of regulator 124 tends to slow down the advance of pusher rod 12 so as not to put more of the highly combustible fuel into the combustion chamber and, thereby, maintain the heat, and therefore the steam flow, at the desired value. Thus, the inputs of regulator 129 consist of a primary signal received from main control 140, a varying signal from regulators 128 and 124 the value of which depends on conditions encountered during combustion, and finally a position feedback signal from motor 142 via detector 145.

Drums 50, 51 and 52 are shown in FIG. 4 to be rotated by motors 160, 161 and 162, respectively. Motor 160 is coupled to drum 50 by gearing 165. Likewise, motor 161 is coupled to motor 51 via gearing 166, and motor 162 is coupled to drum 52 by gearing 167. Motor 160 is controlled by comparator 170 which receives a switchable speed signal from speed controller 172.

Speed controller 172 acts to provide a reference speed signal to motor 160 for rotating drum 50 at a rotational speed commensurate with the speed with which pusher rod 12 advances toward opening 6 of combustion chamber 5. The advance speed of pusher rod 12 is available to speed controller 172 from sensor 147 discussed above. In particular, the speed of pusher rod 12 is determined by the position of throttle valve 146 which, in turn, is set by motor 142. Therefore, by monitoring motor 142, detector 147 can generate a signal which indicates the advance speed and direction of pusher rod 12. Thus, if detector rod 147 generates a signal to speed controller 172 indicative of pusher rod advance, speed controller 172 generates a reference signal for rotating motor 160 at a related rotational speed. If, however, detector 147 indicates to speed controller 172 that pusher rod 12 is being retracted away from opening 6, speed controller 172 causes motor 160 to stop. Alternatively, speed controller 172 can cause motor 160 to rotate at a preset idle speed. In any case, a speed feedback signal is generated on line 173 to regulate motor 160 so that it operates in accordance with the reference signal provided to it from speed controller 172.

The speed of motor 161 is controlled by the output of regulator 174. The input to regulator 174 is provided from the output of regulator 181 via conditioning circuit 180. As explained above, regulator !81 provides a difference between a preset value of the desired steam flow set by 140 and the actual detected value from circuit 184. Conditioning circuit 180 also receives a $\Delta S$ value from circuit 182. The operation of regulator 174 in response to its input signal is described below in the section dealing with drum speed control in response to sensed combustion signals.

Regulator 176 is shown as being provided the output signal from conditioning circuit 180. For ease and simplicity of illustration, its output has not been shown as connected to motor 162 which, in fact, it is. Likewise, drums 53 and 54 are also provided with individual motors and regulators receiving a signal, such as from conditioning circuit 180 or another suitable signal source, as described below. Drum 55, on the other hand, serves to pass ash from the secondary combustion zone to the ash bin 16. Its rotation can be set at a constant level to await consumed fuel being passed to it by drum 54, or it can be stopped until a rotating signal is passed to it when it is determined that consumed fuel is to be dumped from the secondary combustion chamber into the ash bin.

Motors 201 and 202 control the position of throttle valves 101 and 102, respectively. Valves 101 and 102 can throttle the total volume of air flow to a drum, as well a to control the relative flow to either side of the combustion chamber. Thus, motors 201 and 202 can be operated together to turn valves 101 and 102, respectively, in the same direction to throttle total air flow, or they can be operated in opposite directions to direct more air flow to one side than to the other in order to control the transverse air flow, as described below.

Regulator 205 receives one input signal from conditioning circuit 207, and another input signal from processing circuit 209. Conditioning circuit 207 is controlled by one signal from circuit 230 which Can be either S1, S2 or S3 depending on which drum is being controlled (remembering that the air flow to only drum 53 shown in FIG. 4 is merely illustrative, and that ducts and control circuitry are utilized for drums 51–54 also), and the other input is ΔS from circuit 231. Processing circuit 209 receives an air flow measurement from sensor 211 located in a duct branching off from main duct 100 and leading to ducts 53*a*′ and 53*a*″. Thus, the appropriate total amount of air flow to a particular drum is input to regulator 205 from conditioning circuit 207. The actual, measured amount of air flow is obtained from sensor 211 as processed by circuit 209. Therefore, the output of regulator 205 is the difference between the appropriate amount of air flow and the actual value. This measurement is utilized to control the operation of motors 201 and 202 to set the throttling position of valves 101 and 102. Thus, if too much air flow is detected relative to the input value from conditioning circuit 207, both valves 101 and 102 will be moved to throttle the air flow to the extent necessary.

The position of valves 101 and 102 is also affected by sensors 213 and 215. Sensor 213 generates a value of S2, for example, at the right side of the primary combustion zone, while sensor 215 detects the same parameter on the left side. If, for example, sensor 213 detects a higher thermal value on the right side than that which is detected by sensor 215 on the left side, their respective signals will be input via conditioning circuits 217 and 219 to control motors 201 and 202, respectively, accordingly. In particular, for the just-described situation, less primary combustion air will be provided on the right side of the combustion chamber than on the left side in order to produce uniform combustion along the width of the combustion chamber. Therefore, the signal from conditioning circuits 217 and 219 will cause motors 201 and 202 to individually adjust the positions of valves 101 and 102 relative to each other.

The operation of primary air fan 115 is controlled by regulator 221 to provide a preset pressure level. The desired pressure level is preset by device 223. The actual pressure level is sensed by detector 225 and processed by circuit 190. Thus, the output of circuit 190 generates an actual pressure signal which is compared by regulator 221 to the preset signal from device 223. It is important to regulate this pressure to be constant so that the pressure of the primary combustion air fed to roller 50 is maintained constant in order to render variations in readings of detector 22 meaningful as being due to only variation of fuel mass density.

Further details about the operation of the control system is provided below.

Control of Primary Air Volume

Figure 5:
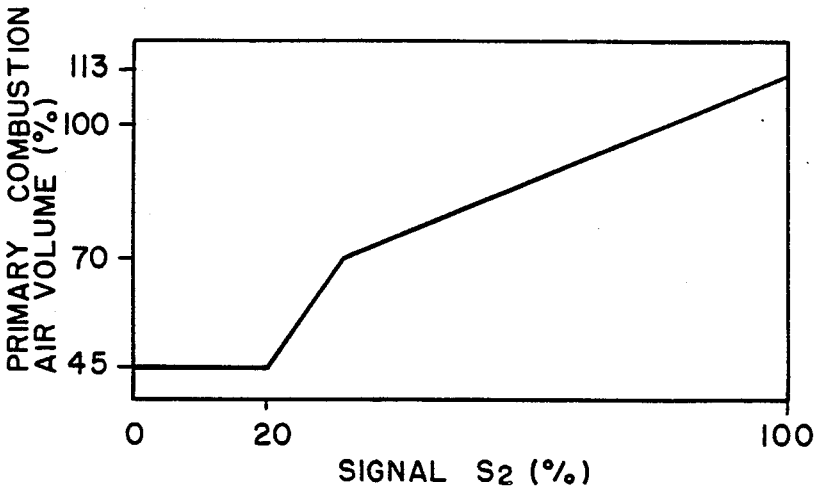
FIG. 5 shows a relationship for controlling the primary air volume introduced into the combustion chamber.

The volume of primary air flow introduced into the combustion chamber 5 is controlled in accordance with the relationship depicted in FIG. 5. The ordinate is a scale showing the percentage of air flow with respect to the nominal, full load capacity of the system. Air flow above that value can be generated, but only for a short time. As shown by the relationship in FIG. 5, it utilizes signal S2 as the control signal to the drums 51 and 52 in the primary combustion zone. If signal S2 from circuit 230 drops below a threshold value of 20%, this is taken as indicative of the fact that fuel in the primary combustion chamber is either completely consumed, or is incombustible. Therefore, a large volume of air is unnecessary. Accordingly, the volume of primary air is adjusted to a minimum level of 45%. Likewise, as signal S2 rises, a suitable amount of air flow is provided in accordance with the graph of FIG. 5.

Distribution of Primary Air Volume Under Rollers 51, 52, 53 and 54

Figure 6A:
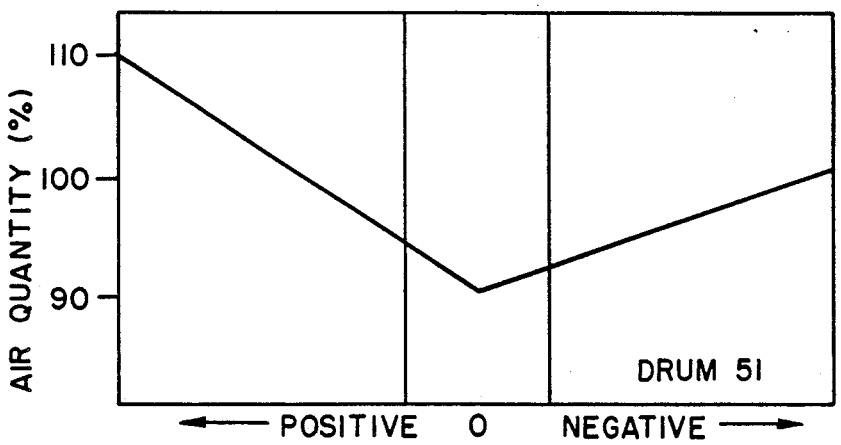
FIGS. 6(*a*)–6(*c*) show a relationship for controlling distribution of air in the combustion chamber.
Figure 6B:
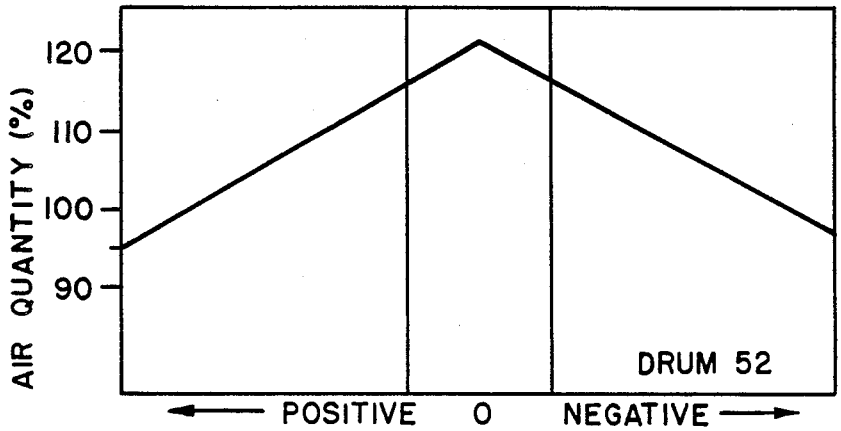
Figure 6C:
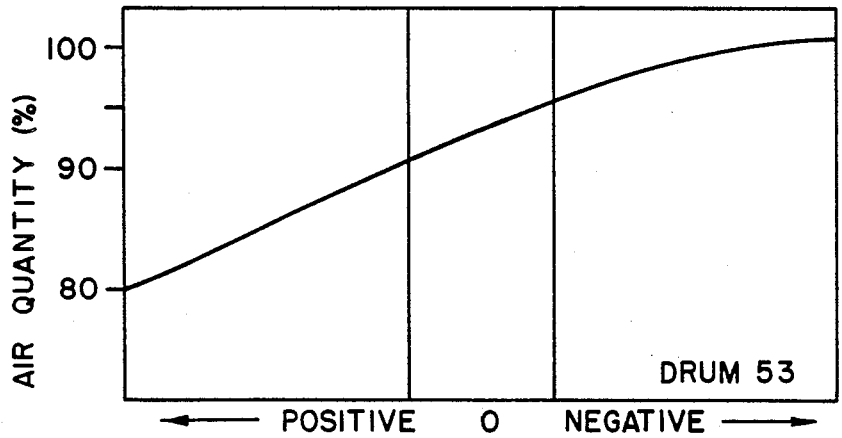

The distribution of primary air volume at rollers 51–54 follows the relationships depicted in FIGS. 6(*a*)–6(*c*). The reasoning behind such distribution is the significance of the difference between signals S1 and S2. In other words:

(S1–S2)—positive: signifies that fire is located in the area of rollers 50 and 51;

(S1–S2)—zero: signifies that fire is located in the area of rollers 51 and 52; and (S1–S2)—negative: signifies that the fire is located in the area of rollers 52 and 53.

The shift in the "center of gravity", as evidenced by ΔS from circuit 231, of the primary air volume as a function of the location of a fire is apparent from FIGS. 6(*a*)–6(*c*). The following chart summarizes what is depicted in these figures.

| | Air quantities at the various rollers | | |
|---|---|---|---|
| Fire Location | Roller 2 | Roller 3 | Roller 4 |
| (S1 - S2) is positive | 110% | 98% | 80% |
| (S1 - S2) is zero | 90% | 120% | 90% |
| (S1 - S2) is negative | 100% | 95% | 110% |

The relationship depicted in FIGS. 6(*a*)–6(*c*) is implemented by regulator 205 for drum 53 depicted in FIG. 4 as well as the corresponding regulators for the other drums which, as stated above, are not explicitly shown.

Control of Roller Speed

The rotational speed of roller 50 is controlled so as to be proportional to the linear speed of pusher rod 12. In particular, as explained above, when the pusher rod is advanced, the rotation of drum 50 is commensurately increased, while with retraction of pusher rod 12, the minimum rotational speed of drum 50 prevails.

Figure 7:
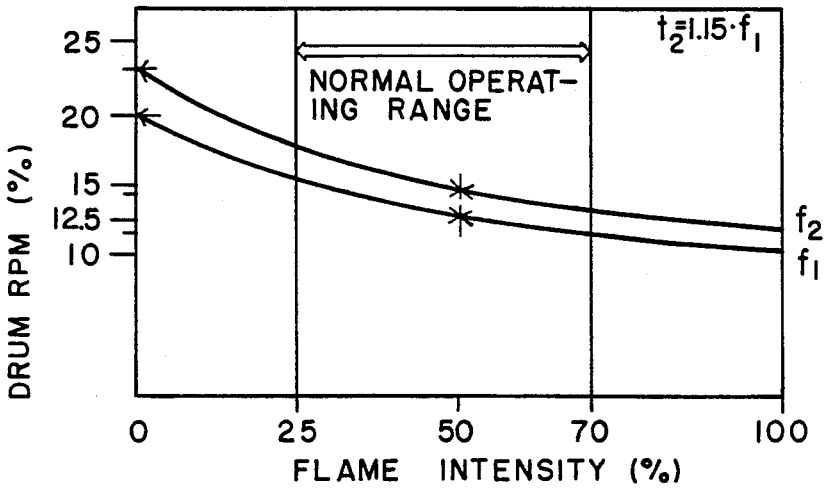
FIG. 7 shows a relationship for controlling the drum rotational speed.

The speed of drums 51 and 5 is controlled by regulators 174 and 176 in such a way as to provide a constant fire intensity in that, with increasing rpm, the length of the fire is extended, and vice versa. Additionally, rotation of these drums exerts an influence upon the stoking action (i.e. increased rpm=improved stoking action). FIG. 7 represents control of drum rotation in response to variation in flame intensity. If the flame intensity, as signified by S1 or S2, drops below 25%, this is taken to mean that (a) poorly ignitable refuse is in the combustion chamber, or (b) fuel in the area of rollers 51 and 52 has been consumed. In either case, this calls for an increase in the drum rotational speed in order to more quickly remove such waste from the combustion chamber and to bring ignitable refuse into the chamber in its place. Thus, the regulation of drum speed switches from function $f_1$ to $f_2$. ($f_2=1.15\times f_1$). This also applies in the event that both signals S1 and S2 are above 70%, which represents an intense fire. In order to make full use of the regulation range, rollers 51 and 52 are controlled individually.

In the secondary combustion zone, the ignited fuel is allowed to dwell until it completely turns to ash. The speed and operation of drums 53 and 54 are controlled accordingly. Thus, if tubes 30 detect heat radiation this means that the fuel in the secondary combustion chamber is still producing heat and should not yet be fed to the ash disposal station. This part of the control system is conventional. Accordingly, no further details with respect to it are necessary.

It should be understood that only the preferred embodiment has been discussed above in detail. Various modifications thereto will be readily apparent to one with ordinary skill in the art. For example, the detection of additional spectra, such as $SO_2$, NO, $NO_2$, OH, CH, and HCO can be used to predict the impurity load of the gases so as to control the waste gas scrubbing systems accordingly. Other parameters that can be usefully detected in order to effectuate the combustion control technique include flame modulation, or flickering, as a heat measurement which discriminates heat generated by the burning fuel from heat radiated by the glowing walls of the furnace, for example. Such a technique is disclosed in DE-OS 35 08253 which is hereby incorporated by reference, spectra of various compounds other than water and carbon dioxide, generated steam mass flow as an auxiliary value for controlling combustion, and fuel density as determined by weight. Also, the directing of combustion air to flow into the secondary combustion zone above the burning fuel on the grid in addition to that entering from below is a well known technique that can be used to advantage. Furthermore, the temperature of the primary combustion air can be raised before it enters the combustion chamber, as by an economizer which utilizes heat in a well known manner from the exiting combustion gasses for this purpose. Likewise, some of the combustion gasses can be returned to the combustion chamber mixed with primary combustion air. In addition, a fuel supply system can be used which can vary the feeding of fuel on one side of the combustion chamber relative to the other side as a way of further refining the control over the combustion process. These and other such modifications are all intended to fall within the scope of the present invention as defined by the following claims.

I claim:

1. A method for controlling combustion of fuel having widely fluctuating thermal values, comprising the steps of:

feeding said fuel to a grid in a combustion chamber via an inlet thereof;

conveying said fuel along said grid through a degassing and evaporating zone, a primary combustion zone, and a secondary combustion zone in said combustion chamber to an ash removal station;

supplying primary combustion air to said grid from therebeneath;

determining a thermal value of said fuel from properties of combustion gases detected in an area including said inlet and said degassing and evaporating zone;

determining fuel density on said grid in said area from air pressure drop in the primary combustion air; and controlling the feeding of fuel to said grid in response to said thermal value and said fuel density so as to derive a constant thermal output.

2. The method of claim 1, wherein said thermal value is determined by measuring the water content of said fuel.

3. The method of claim 1, wherein said thermal value is determined by measuring the carbon dioxide content of combustion gases generated in said combustion chamber.

4. The method of claim 1 wherein combustion gases flow along heating surfaces of a steam generator associated with said combustion chamber, and the generated steam mass flow is detected and used as an auxiliary value for controlling combustion.

5. The method of claim 1, wherein the step of controlling the feeding of fuel to said grid comprises distributing the fuel over said zones.

6. The method of claim 1, wherein the step of controlling the feeding of fuel to said grid comprises controlling the fuel volume feed to said inlet per unit time.

7. The method of claim 7, wherein said thermal value is determined by measuring at least one of the (i) water content of said fuel, and (ii) the carbon dioxide content of said combustion gases.

8. The method of claim 7, wherein radiation in said area is detected, and said water and carbon dioxide contents are determined therefrom.

9. The method of claim 8, wherein the intensity of at least one of the water and carbon dioxide spectra is detected.

10. The method of claim 9, wherein the flame modulation is additionally detected and processed.

11. The method of claim 10, wherein the intensity of additional spectra is detected and processed.

12. The method of claim 11, wherein the intensity of at least one of the spectra is detected and processed which are characteristic of the following compounds: $SO_2$, CO, NO, $NO_2$, OH, CH, $C_2$, HCO.

13. The method of claim 8, wherein radiation in said secondary combustion zone is separately detected and processed.

14. The method of claim 8, wherein radiation in said primary combustion zone is separately detected and processed.

15. The method of claim 1, wherein combustion gases flow along heating surfaces of a steam generator associated with said combustion chamber, and the generated steam mass flow is detected and used as an auxiliary value for controlling combustion.

* * * * *